US006474847B1

(12) United States Patent
Wu

(10) Patent No.: US 6,474,847 B1
(45) Date of Patent: Nov. 5, 2002

(54) DIY ASSEMBLY LAMP STRUCTURE

(76) Inventor: Wen-Chang Wu, No. 10,Lane 191,Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/838,295

(22) Filed: Apr. 20, 2001

(51) Int. Cl.[7] ..... F21V 21/06
(52) U.S. Cl. ..... 362/413; 362/414; 362/285
(58) Field of Search ..... 362/410, 414, 362/413, 287, 285, 418, 431

(56) References Cited

U.S. PATENT DOCUMENTS 2,285,868 A * 6/1942 Muller ..... 362/413
5,155,667 A * 10/1992 Ho ..... 362/413
5,584,398 A * 12/1996 Lin ..... 362/413
D420,757 S * 2/2000 Peterson ..... D26/64
6,203,313 B1 * 3/2001 Yamashita ..... 362/414

* cited by examiner

*Primary Examiner*—Thomas M. Sember
(74) *Attorney, Agent, or Firm*—Troxell Law Office PLLC

(57) ABSTRACT

A DIY assembly lamp structure having a two-section lamp pipe consisting with upper and lower pipe bodies, upper and lower blocks fitted onto the upper and lower pipe bodies, respectively, and four support members that are appropriately contoured by bending. Each support member has a vertical affixing portion that is fastened to the sides of the positioning blocks. The upper pipe body has a brackets disposed vertically and extending upward from its top end with a carrier hole formed in each bracket. A fronting portion having a fastening hole is formed vertically and downward from each of the lateral edges of the cross-shaped positioning blocks for fastening of the vertically disposed, frame member affixing portions to the positioning block fronting portions.

2 Claims, 4 Drawing Sheets

DIY ASSEMBLY LAMP STRUCTURE

BACKGROUND OF THE INVENTION

1) Field of the Invention

The invention herein relates to a DIY assembly lamp structure in which an upper pipe body has carrier holes disposed vertically and extending upward from its top end. Tightly fitted into the carrier holes is an annular-shaped brace rod capable of supporting a lamp shade. A fronting portion having a fastening hole is formed vertically and downward from each lateral edges of a cross-shaped positioning block. These structural features provide for the alignment and fastening of vertically disposed, frame member affixing portions to the positioning block fronting portions, thereby minimizing the physical space needed for assembly, a reduction in storage and shipping dimensions and, furthermore, facilitates user convenience in DIY lamp assembly, while effectively allowing disassembly for replacement and cleaning.

2) Description of the Prior Art

In most conventional lamp structures, the lamp shade is screw-fastened with nuts and bolts to the lamp pipe base. However, with this fastening method, the lamp pipe of the lamp is a lengthy rod-like structure and the lower base of the lamp has a diameter that is somewhat larger than the lamp shade mounting structure. When packaged in cartons, the lower base of the lamp and the lamp pipe occupies substantial space and results in articles requiring excessive room during boxing. Since storage and shipping dimensions cannot be reduced, there is a commensurate increase in product shipping costs.

In addition, since the lamp shade is assembled to the top end of the lamp pipe, if the lamp shade does not meet user requirements for pattern and color, and the lamp shade cannot be removed for cleaning, resulting in user inconvenience. In view of the shortcomings, the inventor of the invention herein conducted research which culminated in the successful development of the invention herein.

SUMMARY OF THE INVENTION

The primary objective of the invention herein is to provide a DIY lamp structure in which an upper pipe body has carrier holes disposed vertically and extending upward from its top end. Tightly fitted into the carrier holes is an annular-shaped brace rod capable of supporting a lamp shade, the annular-shaped brace rod providing for the placement and positioning of the center ring of the lamp shade. A fronting portion having a fastening hole is formed vertically and downward from each of the lateral edges of a cross-shaped positioning block, providing for the alignment and fastening of vertically disposed, frame member affixing portions to the positioning block fronting portions. This minimizes the physical space need for assembly, reduces storage and shipping dimensions and, furthermore, facilitates user convenience in DIY lamp assembly, while effectively allowing disassembly for replacement and cleaning.

DETAILED DESCRIPTION OF THE INVENTION

Figure 1:
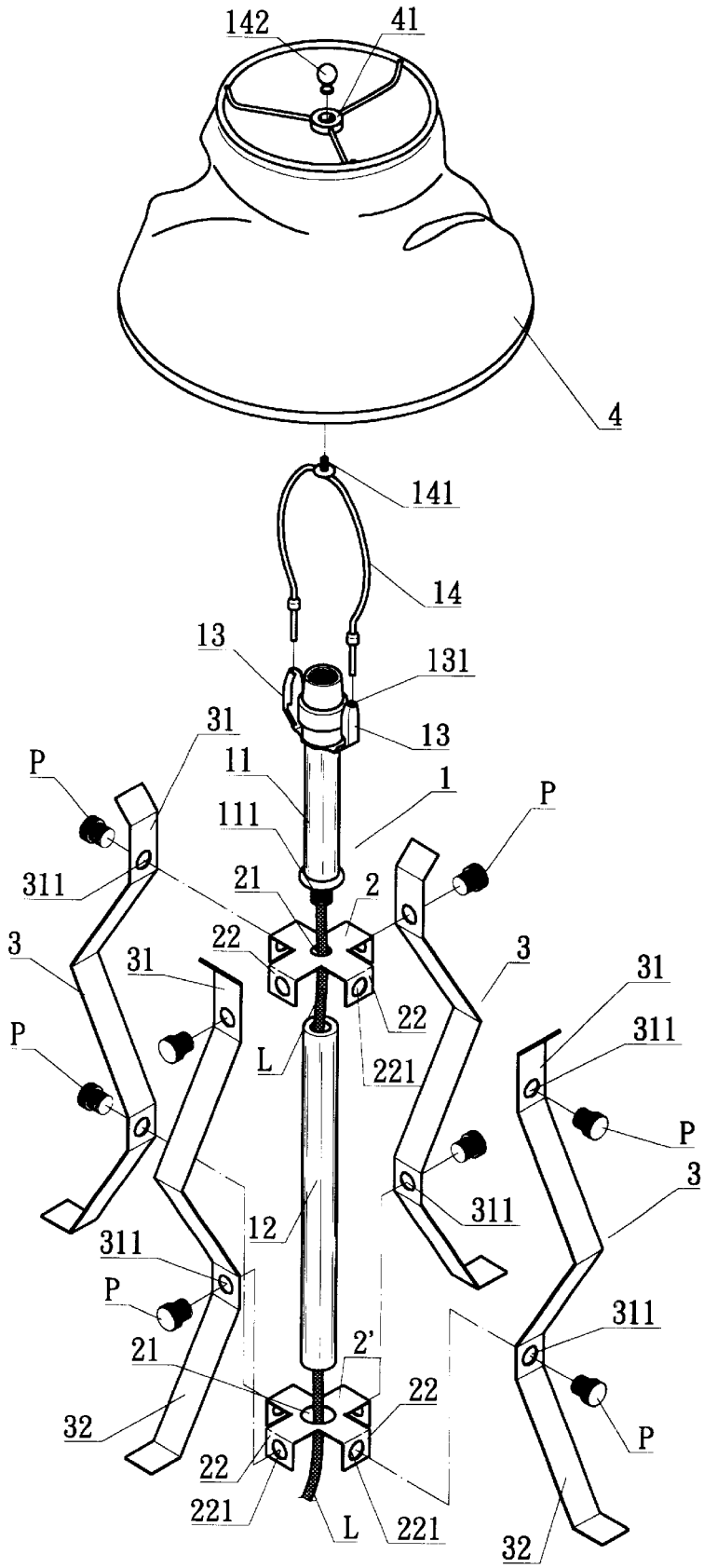
FIG. 1 is an exploded drawing of the invention herein.
Figure 2:
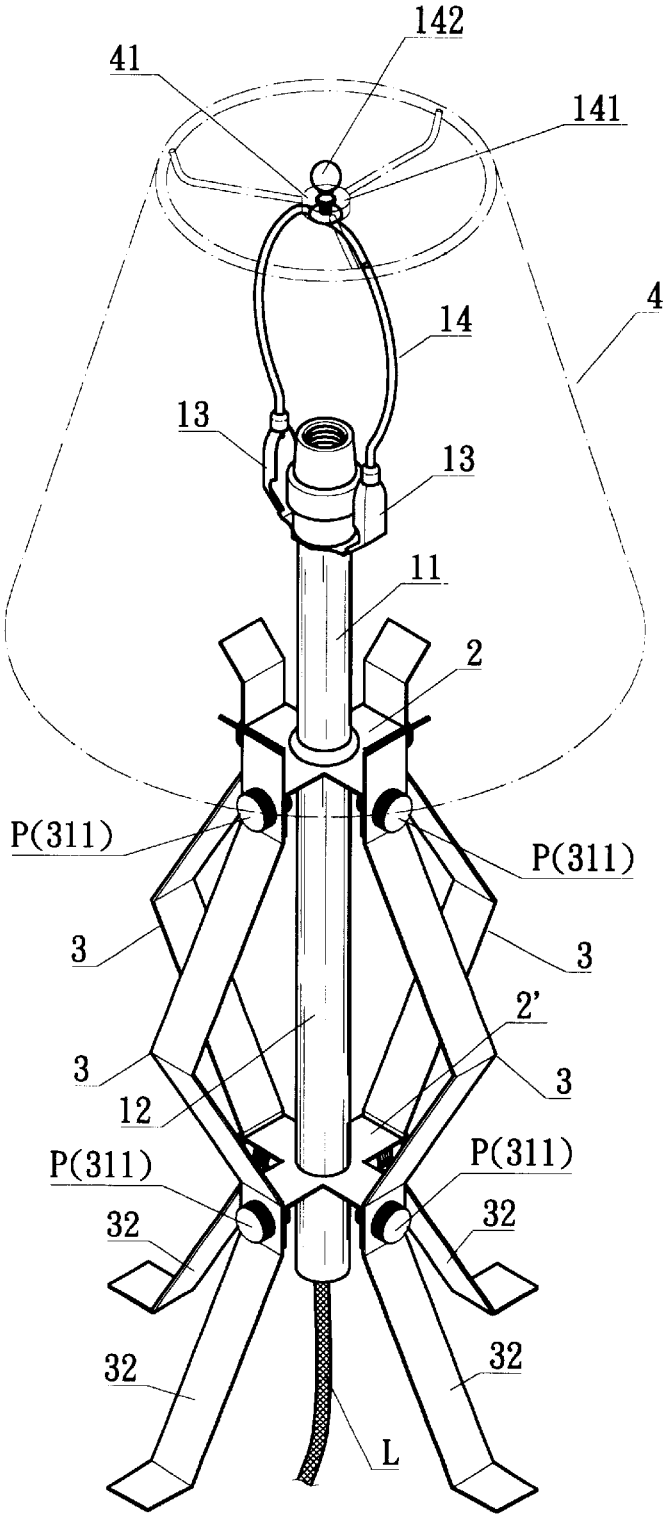
FIG. 2 is an isometric drawing of the invention herein.

Referring to FIG. 1 and FIG. 2, the structural arrangement of the present invention, the invention herein is comprised of a table lamp fixed and erected on a lamp base A structure and a lamp shade 4 structure situated at the top end of the lamp base A that, furthermore, has a degree of folding flexibility and is capable of enhancing aesthetic appearance.

The lamp base A is comprised of a power line L inserted through the interior section and, furthermore, a two-section lamp pipe 1 consisting of an upper and lower pipe body 11 and 12 as well as an upper and lower positioning block 2 and 2' fitted onto the upper and lower pipe body 11 and 12, respectively, and four support members 3 that are appropriately contoured by bending and, furthermore, with each having an affixing portion 31 that is fastened to the side of the positioning block 2, wherein:

The upper pipe body 11 of said lamp pipe 1 has a threaded section 111 projecting from its bottom end that provides for fastening to the lower pipe body 12. The upper pipe body 111 has a bracket 13 disposed vertically and facing upward at each of the two sides of its top end, and a carrier hole 131 is formed in each vertically extending section of the bracket 13. Tightly fitted into the bracket 13 carrier holes 131 is an annular-shaped brace rod 14 capable of supporting the lamp shade 4. The brace rod 14 has threaded stud 141 projecting from its top end that provides for placing a center ring 41 at the upper extent of the lamp shade 4 over the threaded study 141, and a knob 142 is fastened onto the threaded stud 141 to position the lamp shade 4 at the upper extent of the annular-shaped brace rod 14.

The upper positioning block 2 is assembled between the upper and lower pipe body 11 and 12 of the lamp pipe 1, while the lower positioning block 2' is assembled to the bottom end of the lower pipe body 12. The positioning block 2 has a coupling hole 21 at its center and a fronting portion 22 is formed vertically and downward from each of the lateral edges of the positioning block 2 cross with a fastening hole 221 in each fronting portion 22.

The support members 3 are flat structures bent into an appropriate contour, with each support member 3 having a vertical affixing portion 31 formed at the curvature against the lamp pipe 1 and a fastening hole 311 in each affixing portion 31. The length separating every two affixing portions 31 matches the distance between the upper and lower positioning blocks 2 and 2', thereby providing for the alignment and fastening of the frame member 3 affixing portions 31 to the positioning block 2 and 2' fronting portions 22. The bottom ends of the frame members 3 are bent outward into a curve to form feet 32 that serve as the lamp base A stabilized by the frame members 3.

Figure 4:
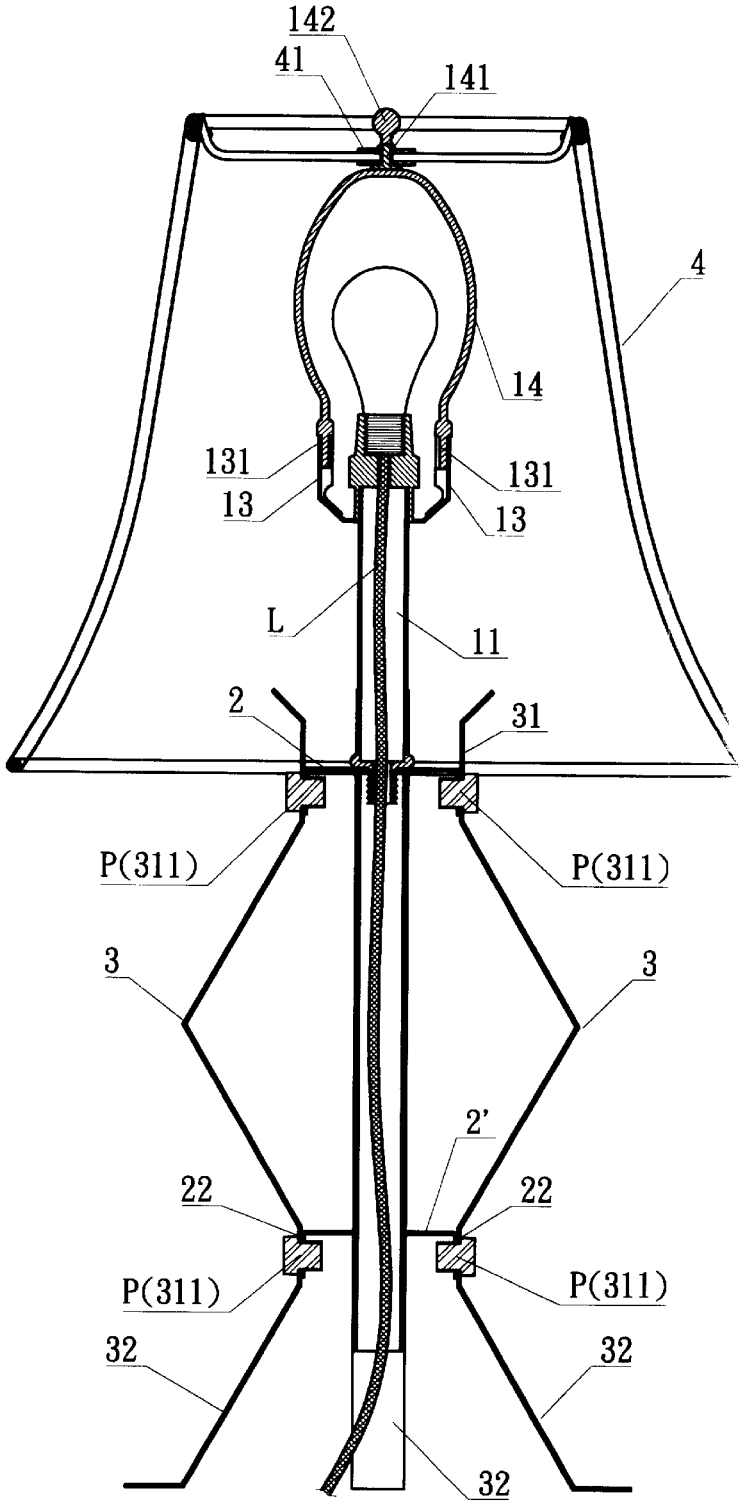
FIG. 4 is a cross-sectional drawing of the embodiment of the invention shown in FIGS. 1 and 2.

The method of assembly, as indicated in FIG. 4, consists of first ensleeving the upper positioning block 2 onto the lamp pipe 1 threaded section 111 at the bottom end of the upper pipe body 11 and then fastening the lower pipe body 12 to the bottom end of the upper pipe body 11 to thereby secure the upper positioning block 2 between the upper and lower pipe bodies 11 and 12. There is a fastening hole 221 in each of the vertically disposed fronting portions 22 of the upper and lower positioning blocks 2 and 2' and the fastening holes 311 in each of the vertically disposed affixing portions 31 of the support members 3 are aligned with them, providing for the sequential insertion of a bolt P into all of the fastening member 3 and positioning block 2 fastening holes 311 and 211 to complete the assembly of the lamp base A structure. The annular-shaped brace rod 14 is snugly fitted into the carrier holes 131 formed at the two sides of the upper pipe body 11 and the center ring 41 of the lamp shade 4 is placed onto the threaded stud 141 at the top end of the annular-shaped brace rod 14. The knob 142 is fastened onto the threaded stud 141 to position the lamp shade 4 at the upper extent of the annular-shaped brace rod 14, thereby completing the lamp structure.

The disassembly arrangement of the invention herein is as follows: the frame members 3 are stacked following removal, and the upper and lower pipe bodies 11 and 12 of the lamp pipe 1, the positioning blocks 2 and 2', and the annular-shaped brace rod 14 situated at the top end of the upper pipe body 11 are respectively removed and arranged. When packaged in cartons, this minimizes the physical space needed, reduces storage and shipping dimensions and, furthermore, facilitates user convenience in DIY lamp assembly, while effectively allowing disassembly for replacement and cleaning.

Figure 3:
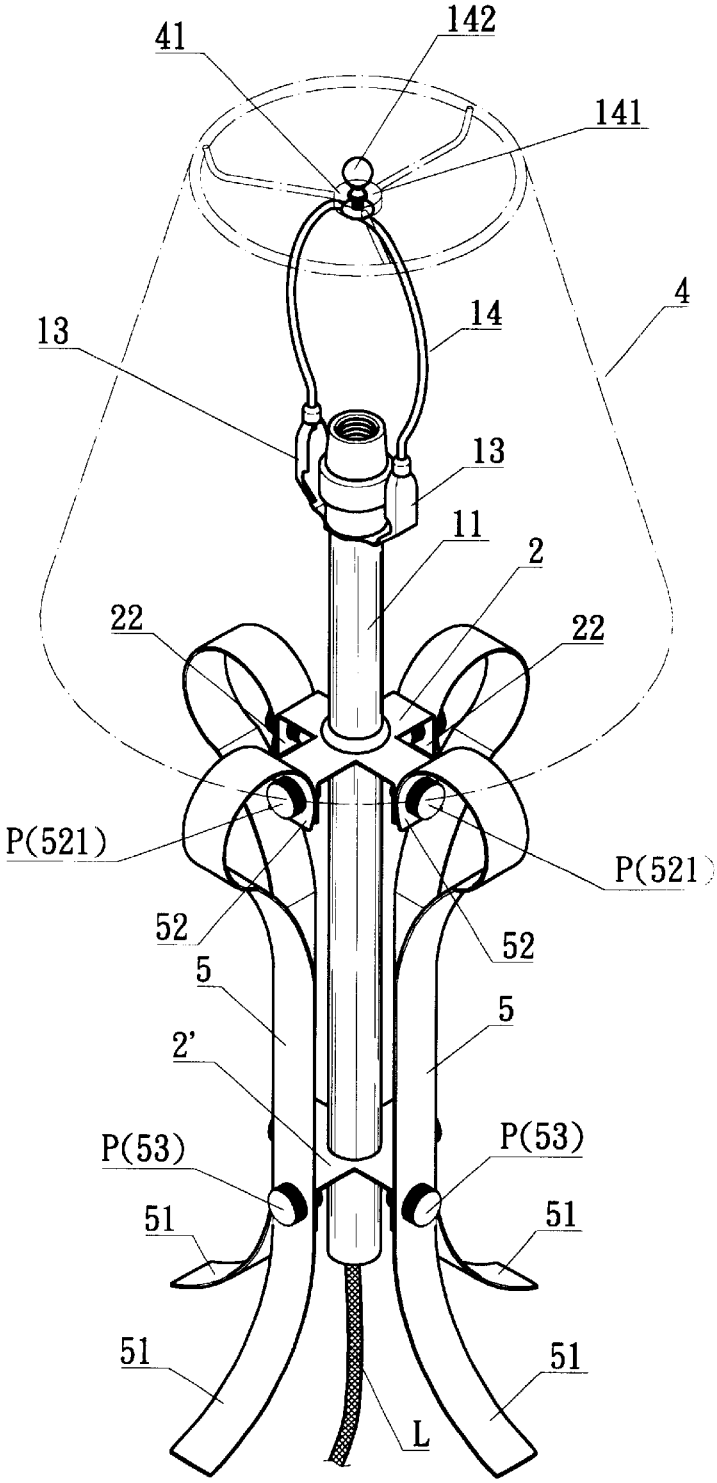
FIG. 3 is an isometric drawing of another embodiment of the invention herein.

Referring to FIG. 3, the drawing of another embodiment of the invention herein, the bottom ends of the frame members 5 are curved slightly outward to form feet 51 that function as the lamp base A stabilized by the frame member 5; the top ends of the frame members 5 are bent inward into a circular shape and conjoinment portions 52 are vertically disposed at the ends. There is a fastening hole 521 in each of the conjoinment portions 52, and there is a fastening hole 53 in each of the support members 5 at the position where they meet the lower positioning block 2' to provide for the alignment and securing of the frame member 5 fastening holes 521 and 53 to the fronting portions 22 of the positioning blocks 2 and 2'.

What is claimed is:

1. A DIY assembly lamp structure comprising a lamp base structure and a lamp shade structure at a top end of the same lamp base structure, wherein:

the lamp base includes a power line inserted through an interior section of a two-section lamp pipe including screw-fastened upper and lower pipe bodies; upper and lower positioning blocks fitted onto the upper and lower pipe bodies, respectively, and four contoured support members;

the upper pipe body having upwardly facing brackets disposed thereon at a top end, a carrier hole being formed in each bracket; tightly fitted into the bracket carrier holes is a brace rod adapted to support a lamp shade thereon, the brace rod having a threaded stud projecting from a top end configured to engage a lamp shade center ring;

the upper positioning block is located between the upper and lower pipe bodies, said lower positioning block is assembled to a bottom end of the lower pipe body; the positioning blocks having center coupling holes and a plurality of fronting portions each having a fastening hole; and, the support members are contoured structures, with each support member having vertical affixing portions with a fastening hole in each affixing portion providing for the fastening of the said frame member affixing portions to the upper and lower positioning blocks, bottom ends of the frame members are bent outwardly to form feet to stabilize the lamp base.

2. The DIY assembly lamp structure of claim 1 wherein top ends of the frame members are bent inwardly into a circular shape with conjoinment portions vertically disposed at ends thereof with a fastening hole in each of the conjoinment portions, for securing of the frame member fastening holes to the fronting portions of the positioning blocks.

* * * * *